US011312034B2

(12) United States Patent
Pereyra

(10) Patent No.: US 11,312,034 B2
(45) Date of Patent: Apr. 26, 2022

(54) MULTIPLE HEAD RAZOR ASSEMBLY

(71) Applicant: German Pereyra, Longmont, CO (US)

(72) Inventor: German Pereyra, Longmont, CO (US)

( * ) Notice: Subject to any disclaimer, the term of this patent is extended or adjusted under 35 U.S.C. 154(b) by 99 days.

(21) Appl. No.: 16/738,379

(22) Filed: Jan. 9, 2020

(65) Prior Publication Data

US 2021/0213632 A1 Jul. 15, 2021

(51) Int. Cl.
*B26B 21/52* (2006.01)
*B26B 21/40* (2006.01)
*B26B 21/22* (2006.01)

(52) U.S. Cl.
CPC ..... *B26B 21/521* (2013.01); *B26B 21/222* (2013.01); *B26B 21/4043* (2013.01)

(58) Field of Classification Search
CPC ..... B26B 21/08; B26B 21/22; B26B 21/40; B26B 21/4012; B26B 21/42; B26B 21/52; B26B 21/521–523
USPC ..... 30/34.1, 47–51; D28/46, 48, 53
See application file for complete search history.

(56) References Cited

U.S. PATENT DOCUMENTS 2,587,964 A * 3/1952 Burns ..... B26B 21/08 30/30
4,461,078 A * 7/1984 Carreker ..... B26B 21/40 30/47
4,501,066 A * 2/1985 Sceberras ..... B26B 21/52 30/47
5,236,439 A * 8/1993 Kozikowski ..... B26B 21/222 30/47
D343,922 S * 2/1994 Ahlgren ..... D28/46
5,307,564 A * 5/1994 Schoenberg ..... B26B 21/14 30/47
5,426,853 A * 6/1995 McNinch ..... B26B 21/14 30/48
D423,143 S * 4/2000 Cowell ..... D28/46
6,052,905 A 4/2000 Branchinelli
6,125,857 A * 10/2000 Silber ..... B26B 21/523 30/34.1
D435,316 S * 12/2000 Chenvainu ..... D28/48
6,308,416 B1 10/2001 Bosy
6,418,623 B1 7/2002 Marcarelli
6,550,148 B2 * 4/2003 Cecil ..... B26B 21/22 30/50
6,560,876 B2 * 5/2003 Carr ..... B26B 21/222 30/34.1
6,581,290 B1 6/2003 Fished
6,598,303 B2 * 7/2003 Bosy ..... B26B 21/52 30/50

(Continued)

FOREIGN PATENT DOCUMENTS

WO WO2000038893 7/2000

*Primary Examiner* — Jason Daniel Prone

(57) ABSTRACT

A multiple head razor assembly includes a handle is gripped during shaving. A plurality of arms is each coupled to and extends away from the handle and each of the arms is directed toward a user's face during shaving. Each of the arms is articulated where to follow contours on the user's face during shaving. A plurality of couplers is each coupled to a respective one of the arms. A plurality of blade units is each removably attachable to a respective one of the arms to shave the user's face. Each of the blade units is spaced apart from each other when the blade units are attached to the respective arms. In this way the blade units can shave lines, shapes and other ornamental elements into the user's beard.

6 Claims, 5 Drawing Sheets

(56) References Cited

U.S. PATENT DOCUMENTS 7,761,999 B2 6/2010 Macove
7,856,725 B2 * 12/2010 Marut ..... B26B 21/523 30/527
8,015,710 B1 9/2011 Zyla
8,366,179 B2 * 2/2013 Houser ..... B62K 19/04 296/180.2
8,387,259 B2 * 3/2013 Starr ..... B26B 21/52 30/50
8,671,576 B1 3/2014 Hotella
8,707,561 B1 * 4/2014 Kneier ..... B26B 21/40 30/50
8,739,411 B2 * 6/2014 Kinghorn ..... B26B 21/42 30/50
9,289,908 B2 3/2016 Marder
9,701,033 B2 7/2017 Tracy
D890,428 S * 7/2020 Simkovitz ..... D28/46
10,800,057 B1 * 10/2020 Blake ..... B26B 21/522
2002/0023352 A1 * 2/2002 Mil'shtein ..... B26B 21/222 30/50
2003/0177648 A1 * 9/2003 Zeiter ..... B26B 21/523 30/526
2003/0188444 A1 * 10/2003 Ferraro ..... B26B 21/22 30/47
2005/0066532 A1 * 3/2005 Kludjian ..... B26B 21/522 30/50
2007/0283567 A1 * 12/2007 Magli ..... B26B 21/22 30/34.1
2013/0298407 A1 * 11/2013 Ramirez ..... B26B 21/52 30/50
2014/0068948 A1 * 3/2014 Marder ..... B26B 21/52 30/47
2014/0116211 A1 * 5/2014 Griffin ..... B26B 21/521 30/47
2014/0259679 A1 * 9/2014 Tracy ..... B26B 21/521 30/50
2015/0183119 A1 * 7/2015 Contaldi ..... B26B 21/522 30/50
2016/0107324 A1 * 4/2016 Robertson ..... B26B 21/52 30/51
2017/0113362 A1 * 4/2017 Tracy ..... B26B 21/521
2017/0274543 A1 * 9/2017 Quarantello ..... B26B 21/522
2019/0084169 A1 * 3/2019 Bonk ..... B26B 21/521
2020/0290226 A1 * 9/2020 Lucchese ..... B26B 21/521
2021/0053240 A1 * 2/2021 Starr ..... B26B 21/52

* cited by examiner

MULTIPLE HEAD RAZOR ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO AN JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to razor devices and more particularly pertains to a new razor device for shaping and grooming unique ornamental features into a beard.

(2) Description of Related Art Including Information Disclosed Under 37 CFR 1.97 and 1.98

The prior art relates to razor devices. The prior art discloses a razor with multiple shaving heads being directed in opposite directions from each other. Additionally, the prior art discloses a razor with multiple arms that are not articulated, each arm having a blade unit being attached thereto. The prior art discloses a razor for trimming lines in beard that includes a space between sets of blades for grooming a beard line of uniform width. The prior art discloses a variety of razors, all with a single arm, that each includes a variety of pivoting mechanisms for attaching a razor blade thereto. Additionally, the prior art discloses a razor having a plurality of arms, being spayed apart from each other, that each has a razor blade being removably attached thereto.

BRIEF SUMMARY OF THE INVENTION

An embodiment of the disclosure meets the needs presented above by generally comprising a handle is gripped during shaving. A plurality of arms is each coupled to and extends away from the handle and each of the arms is directed toward a user's face during shaving. Each of the arms is articulated where to follow contours on the user's face during shaving. A plurality of blade units is each removably attachable to a respective one of the arms to shave the user's face. Each of the blade units is spaced apart from each other when the blade units are attached to the respective arms. In this way the blade units can shave lines, shapes and other ornamental elements into the user's beard.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
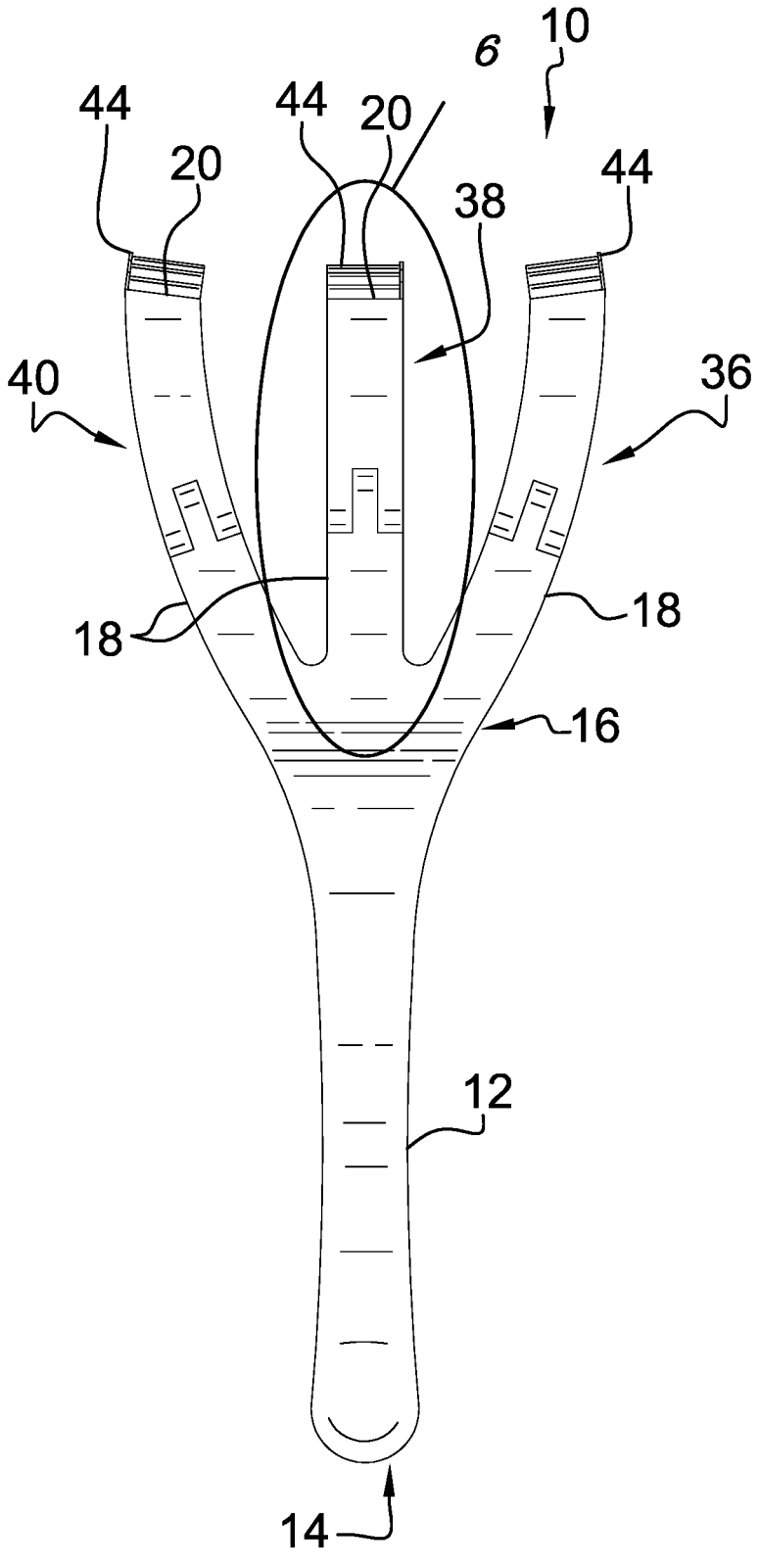
FIG. 1 is a back view of a multiple head razor assembly according to an embodiment of the disclosure.
Figure 2:
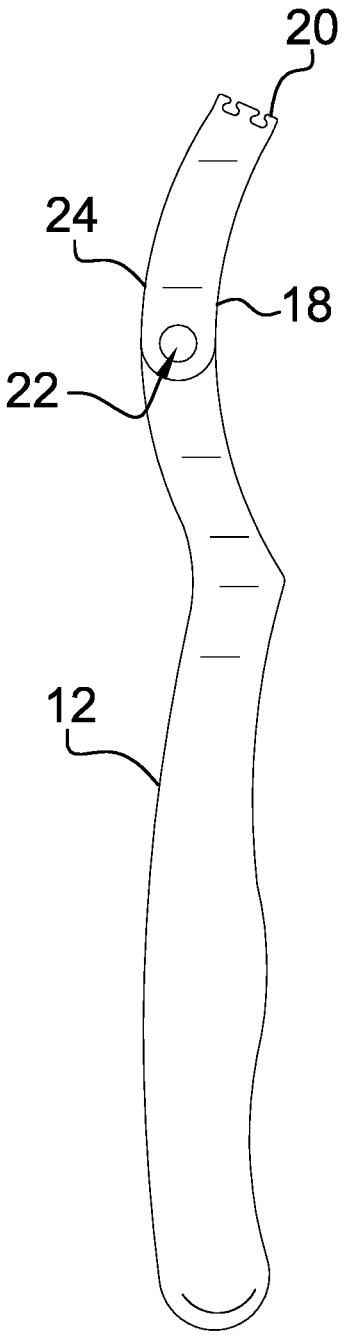
FIG. 2 is a right side view of an embodiment of the disclosure.
Figure 3:
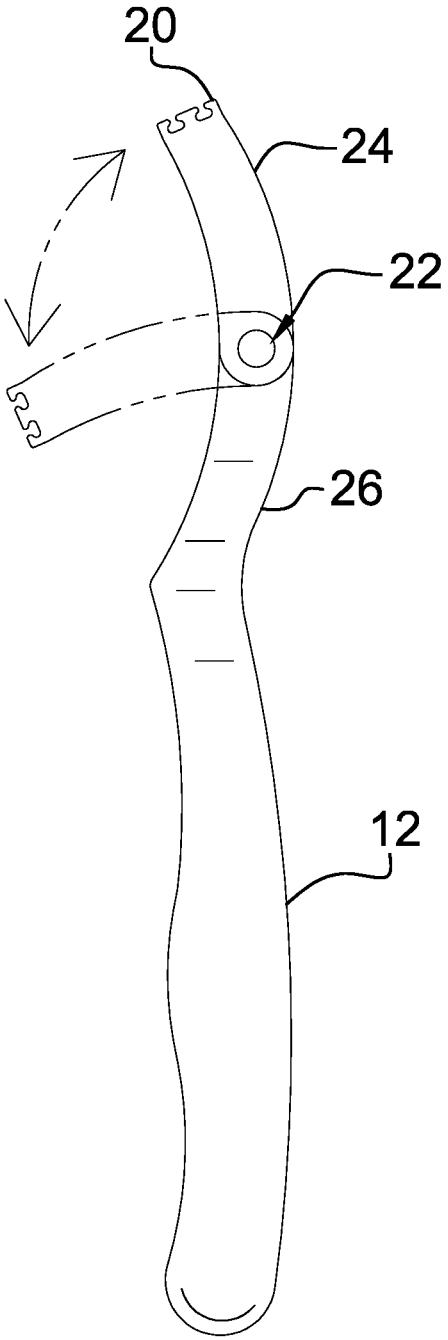
FIG. 3 is a left side view of an embodiment of the disclosure.
Figure 4:
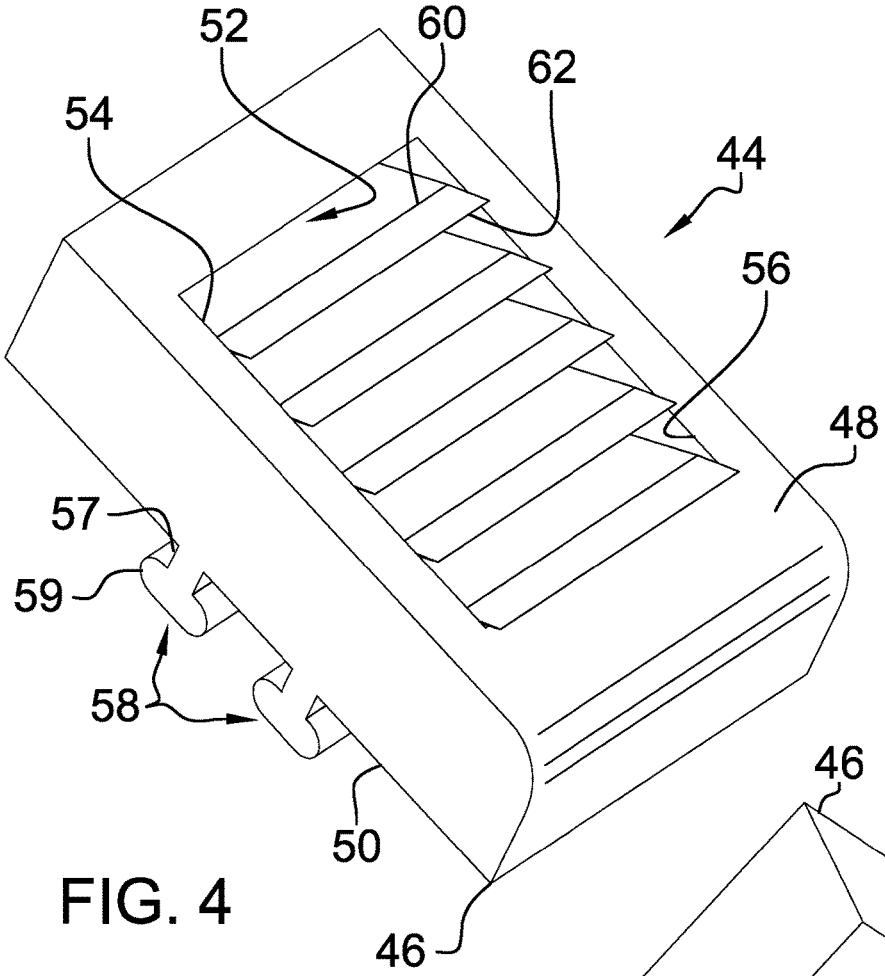
FIG. 4 is a front perspective view of a blade unit of an embodiment of the disclosure.
Figure 5:
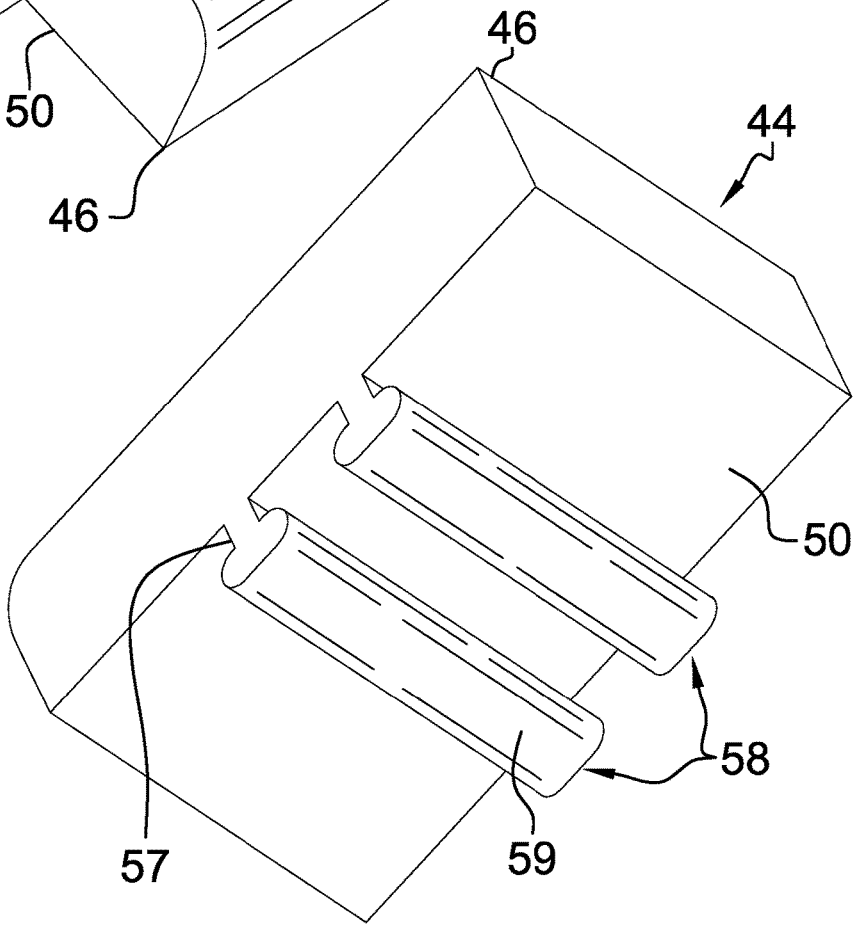
FIG. 5 is a back perspective view of a blade unit of an embodiment of the disclosure.
Figure 6:
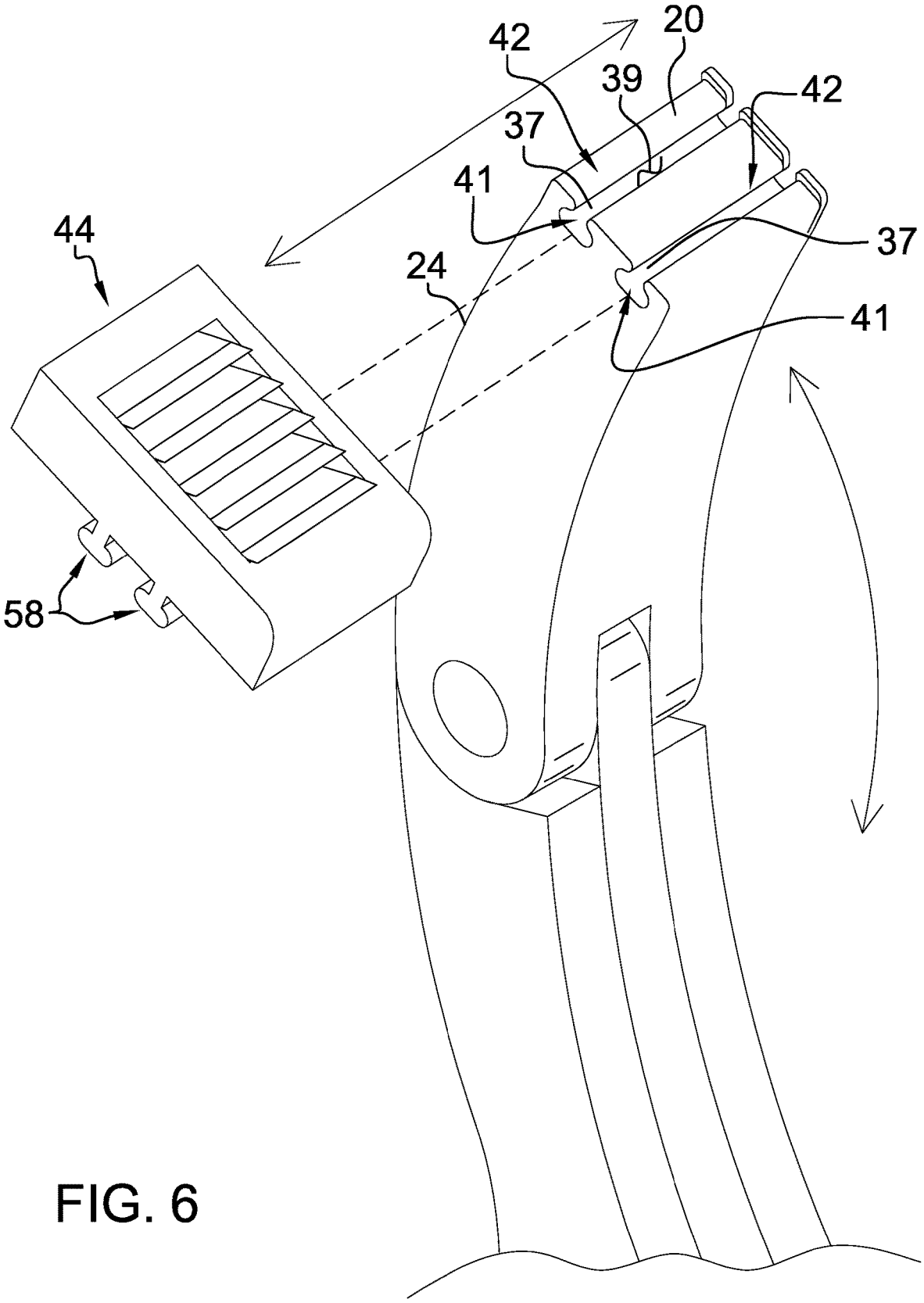
FIG. 6 is a detail view taken from circle 6 of FIG. 1 of an embodiment of the disclosure.
Figure 7:
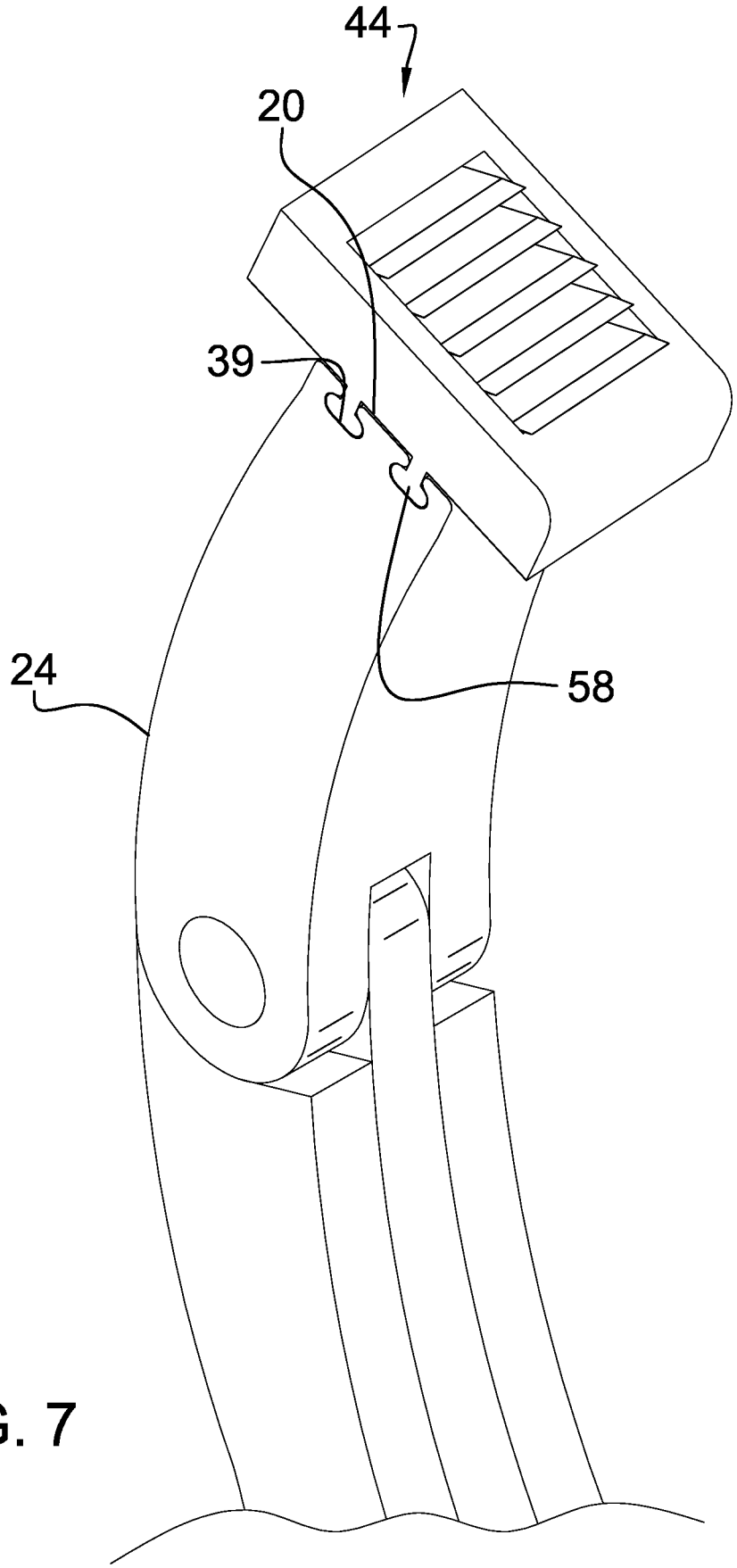
FIG. 7 is a perspective view of an arm and a blade unit of an embodiment of the disclosure.

With reference now to the drawings, and in particular to FIGS. 1 through 7 thereof, a new razor device embodying the principles and concepts of an embodiment of the disclosure and generally designated by the reference numeral 10 will be described.

As best illustrated in FIGS. 1 through 7, the multiple head razor assembly 10 generally comprises a handle 12 that is gripped during shaving. The handle 12 has a first end 14 and a second end 16, the handle 12 widens between the first end 14 and the second end 16. The handle 12 may have a length ranging between approximately 6.0 inches and 7.0 inches.

A plurality of arms 18 is each coupled to and extends away from the handle 12 such that each of the arms 18 is directed toward a user's face during shaving. The arms 18 are spaced apart from each other on the handle 12. Each of the arms 18 is articulated thereby facilitating each of the arms 18 to pivot responsive to moving over contours on the user's face during shaving. Each of the arms 18 is positioned on the second end 16 of the handle 12 and each of the arms 18 has a distal end 20 with respect to the handle 12. Each of the arms 18 has an joint 22 that is positioned between the distal end 20 and the second end 16 to define a first portion 24 of the arms 18 that is pivotally coupled to a second portion 26 of the arms 18.

The plurality of arms 18 includes a first outer arm 36, a central arm 38 and a second outer arm 40. Each of the first outer arm 36 and the second outer arm 40 is curved between the second end 16 of the handle 12 and the distal end 20. Moreover, the first outer arm 36 and the second outer arm 40 curve away from the central arm 38 in opposite directions from each other. Each of the arms 18 curves forwardly between the second end 16 of the handle 12 and the distal end 20 of the arms 18. The distal end 20 of each of the arms 18 may be distributed over a total width of approximately 2.0 inches. Additionally, the arms 18 may be spaced apart from each other a distance of approximate 0.375 inches.

A plurality of couplers 42 is each coupled to a respective one of the arms 18. Each of the couplers 42 is positioned on the distal end 20 of the respective arm 18. Each of the couplers 42 may comprise a releasable mechanical fastener that is common to disposable razors. As is most clearly shown in FIGS. 2, 3 and 6, the couplers 42 on each arm 18 comprise a pair of slots 37 that extend into the distal end 20 of the respective arm 18. Each of the slots 37 has a bounding surface 39 that extends laterally in each direction beyond an entry 41 into the slots 37 such that each of the slots 37 has a tubular shape with a horizontal orientation.

A plurality of blade units 44 is provided and each of the blade units 44 is removably attachable to a respective one of the arms 18 to shave the user's face. Each of the blade units 44 is spaced apart from each other when the blade units 44 are attached to the respective arm 18. In this way each of the blade units 44 can shave lines, shapes and other ornamental elements into the user's beard. Each of the blade units 44 comprises a housing 46 that has a front side 48 and a back side 50. The front side 48 has an opening 52 extending therethrough and the opening 52 has a first lateral edge 54 and a second lateral edge 56.

An engagement 58 is coupled to the back side 50 of the housing 46 and the coupler 42 on a respective one of the arms 18 releasably engages the engagement 58 for retaining the housing 46 on the respective arm 18. Moreover, the engagement 58 is concavely arcuate with respect to the back side 50 of the housing 46. As is most clearly shown in FIGS. 4 and 5, the engagement 58 includes a head 59 and a stem 57. The stem 57 extends away from the back side 50 of the housing 46 and the head 59 is oriented transverse with the stem 57. Additionally, the head 59 has a rounded profile that matches the shape of the slots 37 that define the couplers 42 on the arms 18. In this way the head 59 can be slid laterally into the slot 37 of the respective coupler for removably retaining each of the blade units 44 on the arms 18. Moreover, the stem 57 extends outwardly through the entry 41 into the respective slot 37.

Each blade unit 44 includes a plurality of blades 60 that is each coupled to the housing 46. Each of the blades 60 extends between the first lateral edge 54 and the second lateral edge 56 of the opening 52 and each of the blades 60 has a cutting edge 62 that is directed outwardly from the opening 52. Each of the blades 60 is oriented at an angle with respect to the front side 48 of the housing 46 thereby positioning the cutting edge 62 of each of the blades 60 at an optimum angle for shaving whiskers.

In use, the blade units 44 are attached to respective arms 18 and the handle 12 is gripped for shaving. Thus, the blade units 44 can shave stripes, shapes or other ornamental elements in a beard with precise spacing and clean lines. Each of the arms 18 is pivotable forwardly on the respective arm 18 to remove or replace the blade unit on the respective arm 18. Additionally, each of the arms 18 is pivoted rearwardly into a shaving position prior to shaving.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A multiple head razor assembly being configured to shave decorative elements into a beard, said assembly comprising:

a handle being configured to be gripped during shaving, said handle having a first end and a second end, said handle widening between said first end and said second end;

a plurality of arms, each of said arms being coupled to and extending away from said second end of said handle wherein each of said arms is configured to be directed toward a user's face during shaving, said arms being spaced apart from each other on said handle, each of said arms being articulated, each of said arms having a distal end with respect to said handle, each of said arms having a joint being positioned between said distal end and said second end to define a first portion of said arms being pivotally coupled to a second portion of said arms wherein each of said arms is configured to pivot responsive to moving over contours on the user's face during shaving;

a plurality of couplers, each of said couplers being positioned on said distal end of a respective one of said arms; and a plurality of blade units, each of said blade units being removably attachable to a respective one of said couplers wherein each of said blade units is configured to shave the user's face, each of said blade units being spaced apart from each other when said blade units are attached to said respective arms.

2. The assembly according to claim 1, wherein said plurality of arms includes a first outer arm, a central arm and a second outer arm, each of said first outer arm and said second outer arm curving between said second end of said handle and said distal end, said first outer arm and said second outer arm curving away from said central arm in opposite directions from each other.

3. The assembly according to claim 1, wherein each of said blade units comprises a housing having a front side and a back side wherein each of said back sides is removably attached to said respective one of said couplers, said front side having an opening extending therethrough, said housing having a first lateral edge and a second lateral edge defining said opening.

4. The assembly according to claim 3, wherein each of said blade units includes an engagement being coupled to said back side of said housing, said couplers on said respective one of said arms releasably engaging said engagements for removably retaining said housings on said respective one of said arms.

5. The assembly according to claim 4, further comprising a plurality of blades, each of said blades being coupled to said housing, each of said blades extending between said first lateral edge and said second lateral edge of said opening, each of said blades having a cutting edge being directed outwardly from said opening, each of said blades being oriented at an angle with respect to said front side of said housing thereby positioning said cutting edge of each of said blades at an angle for shaving whiskers.

6. A multiple head razor assembly being configured to shave decorative elements into a beard, said assembly comprising:

a handle being gripped during shaving, said handle having a first end and a second end, said handle widening between said first end and said second end;

a plurality of arms, each of said arms being coupled to and extending away from said second end of said handle wherein each of said arms is configured to be directed toward a user's face during shaving, said arms being spaced apart from each other on said handle, each of said arms being articulated, each of said arms having a distal end with respect to said handle, each of said arms having a joint being positioned between said distal end and said second end to define a first portion of said arms being pivotally coupled to a second portion of said arms wherein each of said arms is configured to pivot responsive to moving over contours on the user's face during shaving, said plurality of arms including a first outer arm, a central arm and a second outer arm, each of said first outer arm and said second outer arm curving between said second end of said handle and said distal end, said first outer arm and said second outer arm curving away from said central arm in opposite directions from each other;

a plurality of couplers, each of said couplers being positioned on a distal end of a respective one of said arms; and a plurality of blade units, each of said blade units being removably attachable to a respective one of said arms wherein each of said blade units is configured to shave the user's face, each of said blade units being spaced apart from each other when said blade units are attached to said respective arms wherein each of said blade units is configured to shave lines, shapes and other ornamental elements into the user's beard, each of said blade units comprising:

a housing having a front side and a back side wherein each of said back sides is removably attached to said respective one of said couplers, said front side having an opening extending therethrough, said housing having a first lateral edge and a second lateral edge defining said opening;

an engagement being coupled to said back side of said housing, said couplers on said respective one of said arms releasably engaging said engagements for removably retaining said housings on said respective one of said arms, and a plurality of blades, each of said blades being coupled to said housing, each of said blades extending between said first lateral edge and said second lateral edge of said opening, each of said blades having a cutting edge being directed outwardly from said opening, each of said blades being oriented at an angle with respect to said front side of said housing thereby positioning said cutting edge of each of said blades at an angle for shaving whiskers.

* * * * *